United States Patent [19]

Partridge

[11] Patent Number: 4,844,651

[45] Date of Patent: Jul. 4, 1989

[54] FASTENING CLIP

[76] Inventor: Juergen W. Partridge, R.R. #2, Brampton, Ontario, Canada, L6V 1A1

[21] Appl. No.: 79,427

[22] Filed: Jul. 30, 1987

[51] Int. Cl.[4] ..... F16B 5/00

[52] U.S. Cl. ..... 403/406.1; 52/714; 411/477

[58] Field of Search ..... 411/477, 478, 466, 467, 411/468; 52/714, 715; 403/400, 386, 406.1, 405.1

[56] References Cited

U.S. PATENT DOCUMENTS

| | | | |
|---|---|---|---|
| 233,696 | 10/1880 | Raisor | 403/406.1 X |
| 441,227 | 11/1890 | Cary | 411/466 X |
| 1,783,391 | 12/1930 | Schorr et al. | 52/714 |
| 2,303,103 | 11/1942 | Adams | 52/715 |
| 2,966,705 | 1/1961 | Massey | 52/714 X |
| 4,296,580 | 10/1981 | Weinar | 52/714 X |
| 4,620,403 | 11/1986 | Field | 52/715 X |

*Primary Examiner*—Neill R. Wilson
*Assistant Examiner*—Curtis B. Brueske
*Attorney, Agent, or Firm*—Saidman, Sterne, Kessler & Goldstein

[57] ABSTRACT

A fastening clip for use in wooden deck construction and the like comprises a rectangular strip of galvanized steel having a stamped-out central portion forming a perpendicular shank terminating in a parallel arrow-head-like end for piercing the edge of a wooden plank. Nailing or screwing holes are provided in the strip on either side of stamped-out portion.

6 Claims, 2 Drawing Sheets

FASTENING CLIP

BACKGROUND OF THE INVENTION

1. Field of the Invention

The present invention is directed to fastening means for use in wood construction and particularly for such construction where nails should not be visible. More particularly, the invention is directed to a fastening clip suitable for use in constructing wooden decks and the like.

2. Prior Art of the Invention

In constructing wooden decking it is known to construct widely spaced support beams or joists first then to cover the area with abutting planks layed across the transversal joists. The planks of wood are fastened by nailing them to the edge - and cross-wise layed joists underneath. The nail heads are therefore visible, which is generally not desirable particularly if they rust as in outside decking structures. Another disadvantage of using nails is that in horizontal structures the depressions created in the top surface of the planks by nailing them collect rain water and accelerate the deterioration of the wooden planks.

It is therefore desirable to provide a fastening clip which permits the construction of wooden decks and the like without any visible nails.

SUMMARY OF THE INVENTION

The present invention provides a fastening clip that is easy to use, simple in structure and is, therefore, simple to manufacture by metal stamping techniques.

The fastening clip comprises a metal strip having predetermined thickness and having a central portion thereof stamped out to protrude on one side and adapted to engage an edge of a wooden plank.

The fastening clip has at least one hole for nailing, screwing, or otherwise fastening it on one side of the central stamped-out portion.

Preferably, the fastening clip has another hole on the other side of the stamped-out portion.

In the preferred embodiment, the central stamped-out portion is shaped to form a shank perpendicular to the metal strip and terminating in a tapered arrowhead-like portion parallel to the metal strip for piercing the edge of a wooden plank.

Preferably, the fastening clip is made of galvanized steel of sufficient thickness to provide the requisite rigidity. In many applications sixteenth of an inch thickness is adequate.

BRIEF DESCRIPTION OF THE DRAWINGS

The preferred embodiment of the present invention will now be described in detail in conjunction with the attached drawings, in which.

DETAILED DESCRIPTION OF THE PREFERRED EMBODIMENT

Figure 1:
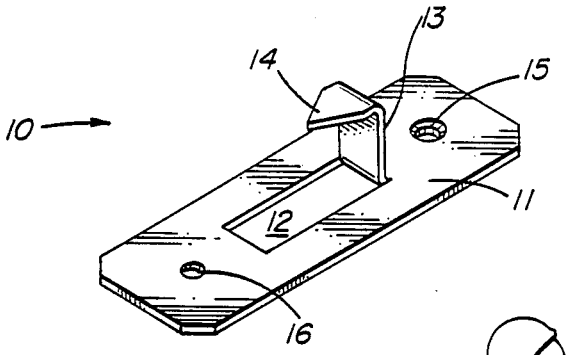
FIG. 1 is a perspective view of the fastening clip according to the present invention.

Referring to FIG. 1 of the drawings, a fastening clip 10 according to the present invention is shown in perspective. The clip 10 comprises a substantially rectangular metal strip 11 having a central portion 12 thereof stamped out to form a shank 13 perpendicular to the strip 11 and terminating in a tapered arrow-like end facing in the same direction as it was before being stamped out. The strip 11 has two holes 15 and 16 punched in on either side of the stamped-out portion 12.

Figure 2:
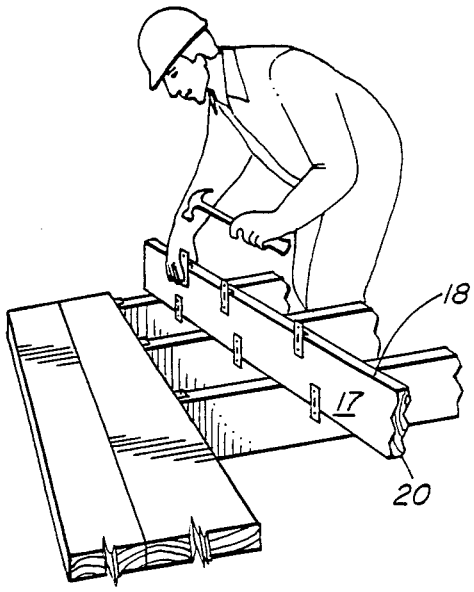
FIG. 2 is a perspective view illustrating the manner in which the fastening clip of FIG. 1 is used to construct a wooden deck.
Figure 3:
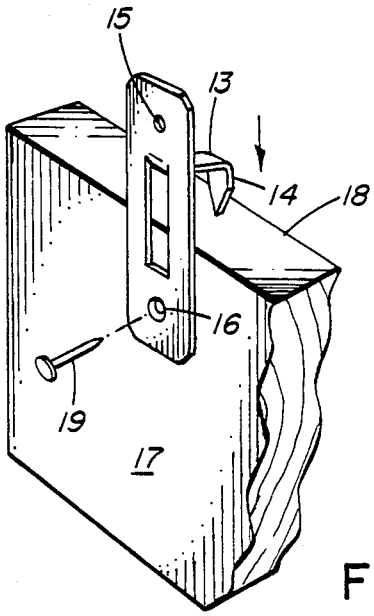
FIG. 3 is a perspective view showing how the fastening clip of FIG. 1 is fastened to a wooden plank.

Referring now to FIGS. 2 and 3, the clip 10 is first hammered into a wooden plank 17 at the appropriate position by driving the arrow-like end 14 into an edge 18 of the plank 17; it is then optional, for greater rigidity of construction, to drive a nail 19 (or to use a screw) through the hole 16 into the plank 17. This last step, however, is normally not required for deck construction and the hole 16 may be dispensed with.

Figure 4:
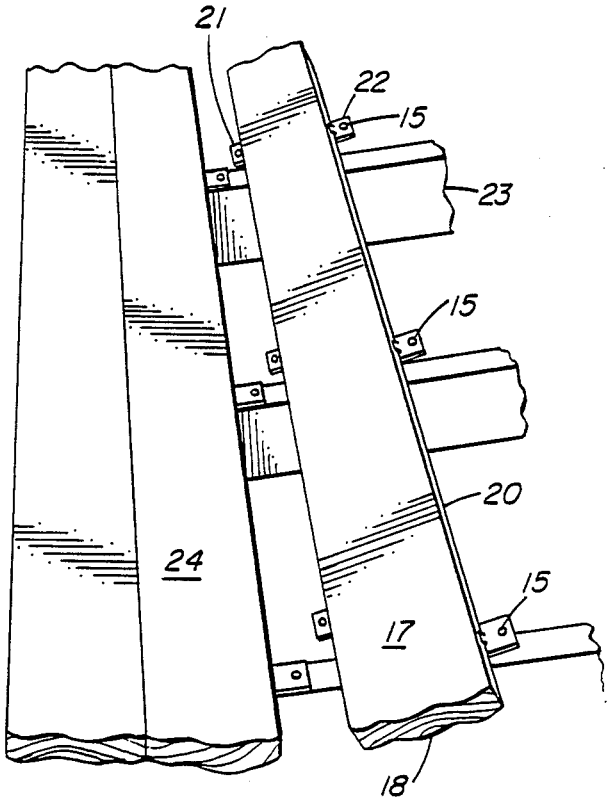
FIG. 4 is a perspective view showing how a wooden plank is layered after all fastening clips have been attached to it.

As may be seen in FIG. 2, the plank 17 has a plurality of clips hammered into either of its long edges 18 and 20. The manner of arranging the clips is shown more clearly in FIG. 4 of the drawings. As may be seen, the clips are prepared as are clips 21 and 22. The clip 21 is positioned to the side of joist 23 when the plank 17 is in place, while the clip 22 is positioed to coincide with the joist 23 to which it will be nailed through the hole 15 once the plank 17 is in place. Thus once all clips have been hammered into the edges 18 and 20 of the plank 17, the plank is laid such that the protruding ends of clips at the edge 18 are inserted underneath previously installed plank 24. All holes corresponding to the hole 15 in FIG. 1 would then be resting on the joists and accessible for nailing thereto, thereby fastening and retaining the edge 20 on the joists. At the same time, the clip ends at the edge 18 prevent that edge from moving or curling upwardly, which could happen when the plank 17, for example, becomes wet.

The fastening clips are preferably made from onesixteenth inch galvanized steel for installing, say, a cedar deck having two-by-six inch planks. A clip measures $3\frac{1}{2}\times1\frac{1}{8}$ inches, and the stamped-out area $1\frac{1}{4}\times\frac{3}{8}$ inches. The length of the shank 13 is approximately $\frac{5}{8}$ inch, the remainder, being $\frac{5}{8}$ inch, is the length from the shank 13 to the tip of the arrow-like end 14. It is preferably that the hole 15 be countersunk on the side of the shank 13, while the hole 16 be countersunk on the opposite side.

What is claimed is:

1. A fastening clip and wooden plank assembly comprising a metal strip having predetermined thickness and having a central portion thereof stamped out to protrude on one side and shaped to form a shank perpendicular to the metal strip and terminating in a tapered arrowhead-like portion parallel to the metal strip for piercing and engaging an edge of a first wooden plank, wherein the portion of said metal strip projecting beyond the edge of said wooden plank on one side of said shank engages the underside of an edgewise contiguous second wooden plank anchored to a plurality of supporting joists running crosswise underneath said first and second wooden planks, thereby preventing said first wooden plank from curling upwardly along said edge.

2. The fastening clip as defined in claim 1, further comprising at least one hole in the metal strip for nailing or screwing on one side of the central stamped-out portion.

3. The fastening clip as defined in claim 2, said metal strip being substantially rectangular in shape.

4. The fastening clip as defined in claim 3, further comprising another hole in the metal strip on the other side of said central stamped-out portion.

5. The fastening clip as defined in claim 4, said fastening clip made from galvanized steel having predetermined thickness.

6. The fastening clip as defined in claim 5, said metal strip being one sixteenth inch thick.

* * * * *